United States Patent [19]

Cwielong et al.

[11] Patent Number: 4,887,991

[45] Date of Patent: Dec. 19, 1989

[54] DRIVE ASSEMBLIES FOR CHAIN-DRIVEN MINING MACHINERY

[75] Inventors: Heinrich Cwielong; Wilfried Mertens; Gerhard Merten, all of Lünen, Fed. Rep. of Germany

[73] Assignee: Gewerkschaft Eisenhutte Westfalia GmbH, Fed. Rep. of Germany

[21] Appl. No.: 340,760

[22] Filed: Apr. 20, 1989

[30] Foreign Application Priority Data

Apr. 28, 1988 [DE] Fed. Rep. of Germany ..... 3814396

[51] Int. Cl.[4] ..... F16H 57/00

[52] U.S. Cl. ..... 474/92; 474/273

[58] Field of Search ..... 474/152, 92, 273; 198/497, 735; 299/82–84; 175/313

[56] References Cited

U.S. PATENT DOCUMENTS 4,445,878 5/1984 Linke et al. ..... 474/92

*Primary Examiner*—Thuy M. Bui

*Attorney, Agent, or Firm*—Samuels, Gauthier, Stevens & Kehoe

[57] ABSTRACT

A plough drive employs a plough box mounted face to face on a side plate or intermediate plate of a machine frame of a scraper-chain conveyor. A rotatable chain wheel is disposed in the box for driving a chain coupled to the plough. A chain stripper seats in a pocket in the box and is locked therein. The stripper can be withdrawn laterally from the pocket. The stripper is connected to an adjustable annular collar on the casing of a gearing unit which drives the chain wheel and is detachably secured to the side of the box remote from the frame. The gearing unit and stripper can thus be withdrawn together laterally from the box and the chain wheel can likewise be withdrawn laterally via an aperture in the side of the box remote from the frame.

16 Claims, 3 Drawing Sheets

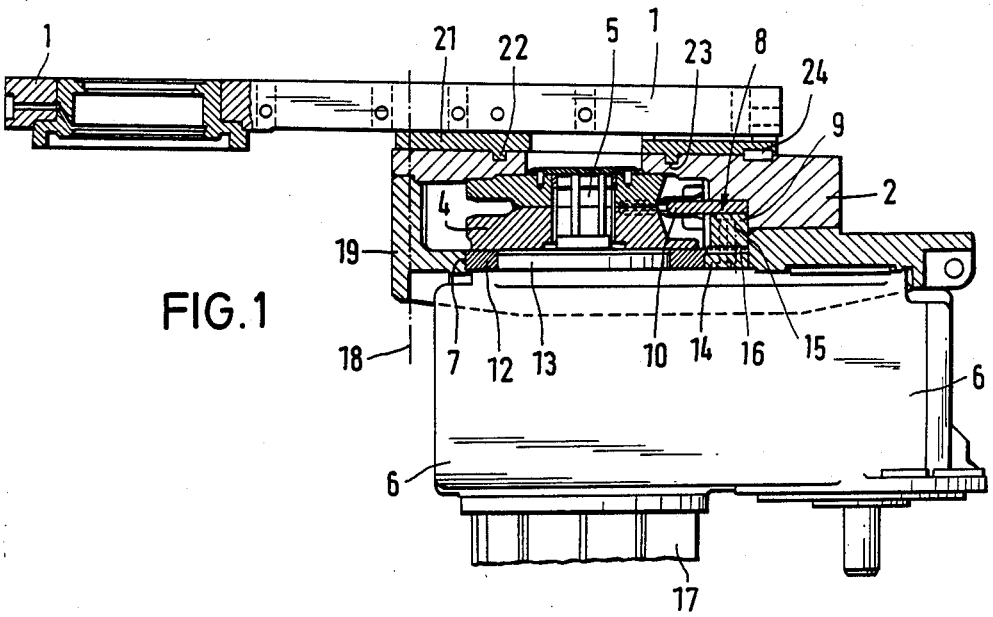
FIG.1
FIG.5
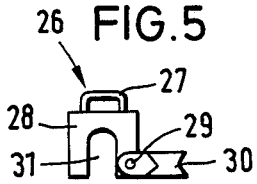
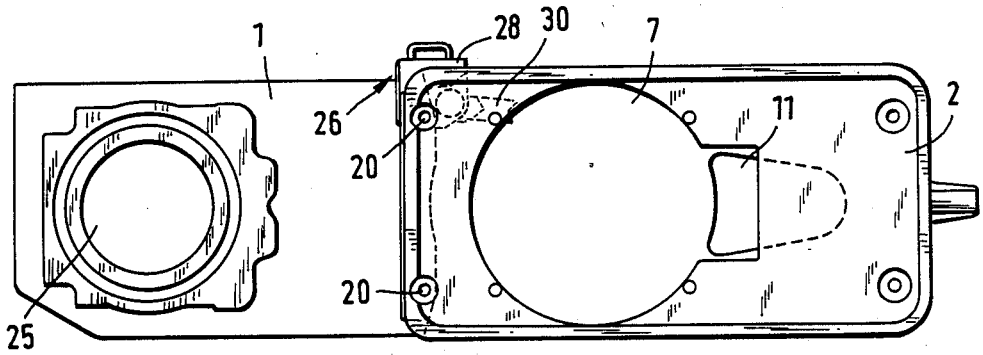
FIG.2

DRIVE ASSEMBLIES FOR CHAIN-DRIVEN MINING MACHINERY

FIELD OF THE INVENTION

The present invention relates to drive assemblies for chain-driven mining machines, particularly ploughs.

BACKGROUND OF THE INVENTION

Chain-driven machines, such as ploughs, have an endless chain which engages around a driven sprocket or chain wheel housed in a so-called plough box. The slender flat plough box is laterally fixed to a machine frame at one end of a scaper-chain conveyor. The enable the chain to be lifted from the chain wheel it is known to use a chain stripper which has a tongue projecting into the periphery of the chain wheel. The stripper is releasable fitted into the plough box and is replaced from time to time. A drive assembly of the aforementioned kind is known from No. DE-OS No. 3,037,585. In this construction the stripper is installed and removed from the above and to secure the stripper in the plough box vertical bolts and a releasable transom piece are used. If the bolts become deformed which is quite common in the harsh operating conditions in an underground mine working, the replacement of the chain stripper is problematic.

In such a drive assembly it is also known to use a locking device to secure the chain during the tensioning operation. Usually such devices employ a pivotable pawl which needs attention frequently to avoid jamming through fouling and corrosion.

A general object of the present invention is to provide an improved drive assembly in which the installation and removal of the stripper and chain wheel is simplified.

SUMMARY OF THE INVENTION

A drive assembly in accordance with the invention employs a box mounted laterally onto a side plate of a machine frame or onto an intermediate plate on this frame side plate. A rotatable chain wheel and a chain stripper are accommodated in the box. A gearing unit is mounted to the side of the box remote from the frame and drives the chain wheel. In accordance with the invention the chain stripper fits into a pocket in the box and the pocket and the stripper are shaped to lock together. This pocket is open from the gearing side to permit the stripper to be inserted and withdrawn. The stripper is connected to the gearing unit so as to form one constructional component therewith. As the gearing unit is pulled off the box and the stripper is automatically removed and conversely when the gearing unit is fitted the stripper located smoothly into the pocket. Usually, the chain wheel would be fixed to the drive shaft of the gearing unit so this component is also demounted when the gearing unit is pulled off. An aperture in a side wall of the box adjacent the gearing unit permits the chain wheel to pass into and out of the box.

An assembly as described operates quite advantageously. The chain stripper needs an operating life which is not shorter than, and is more usually longer than, that of the chain wheel. Frequently, the chain wheel and chain stripper are changed together for convenience and since the gearing must be released from the box to permit the chain wheel to be replaced it is useful that as the gearing unit is pulled off the chain stripper is removed at the same time and can easily be replaced. However, it is quite feasible to replace the stripper independently of the chain wheel if the need should arise. The stripper is reliably secured in the pocket of the box and here a simple polygonal cross-section can serve to lock the stripper in place. This arrangement also ensures the stripper is accurately positioned and supported automatically when it is fitted in the pocket. Conveniently, the pocket merges with the chain wheel access aperture and the pocket can form a radial extension of the aperture. To fix the stripper to the gearing unit it is advantageous to use a special mounting component on the casing of the gearing unit. A suitable mounting component is an annular flange which can be rotatably supported on a collar of the casing. Horizontal bolts oriented parallel to the chain wheel axis can secure the stripper to the mounting flange and preferably these bolts are supplemented by a key connection. The bolts are not subjected to any particularly high shear or bending forces and they can be released quite easily even after a long period of operation. The ability to partly rotate the mounting flange is helpful since it enables the stripper to be pivoted upwardly far above the gearing casing for access and replacement once it has been released from the pocket. Conveniently, the annular mounting flange fits inside the aperture in the box side wall when the gearing unit is fitted in place.

To provide a reliable robust connection between the box and the machine frame it is advisable to use in addition to bolts, a shape locked connection composed of an annular collar engaging in an annular groove between the box inner side wall and a side plate of the frame or an intermediate mounting plate. Preferably, this collar and groove are coaxial with the chain wheel and, at some distance from this shape locked connection, an additional keyed connection is preferably provided.

Further, according to the invention, a portable hand-held locking device is provided for securing the chain during the tensioning operation. Conveniently this device is adapted for use with the assembly as described and has a holder with a U-shaped body which fits onto an end wall of the box via an upper access opening. A pivotable locking pawl supported on the holder can then be swung into position with the holder secured temporarily to lock the chain.

The invention may be understood more readily, and various other aspects and features of the invention may become apparent, from consideration of the following description.

BRIEF DESCRIPTION OF DRAWINGS

Embodiments of the invention will now be described, by way of examples only, with reference to the accompanying drawings, wherein:

FIG. 1 is a part-sectional plan view of a plough drive assembly constructed in accordance with the invention;

FIG. 2 is a side elevation of the assembly with the gearing unit removed;

FIG. 5 is a side view of a locking device for use with the assemblies; and

DESCRIPTION OF PREFERRED EMBODIMENTS

Figure 3:
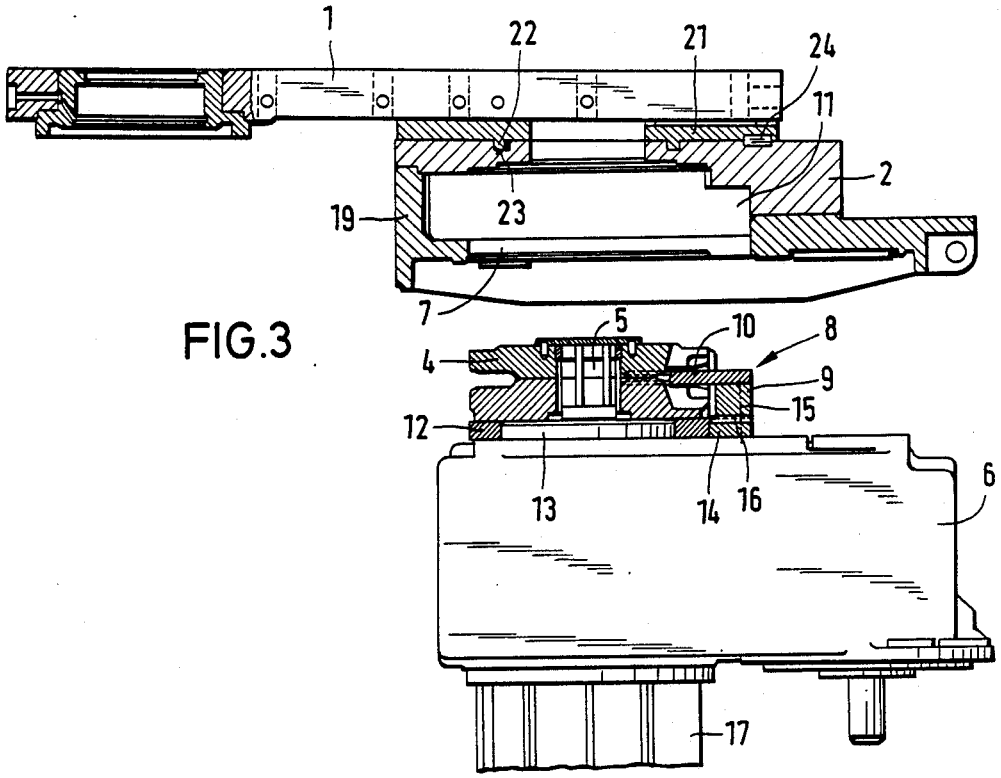
FIG. 3 is a view corresponding to FIG. 1 but with, inter alia, the gearing unit detached from the plough box.
Figure 6:
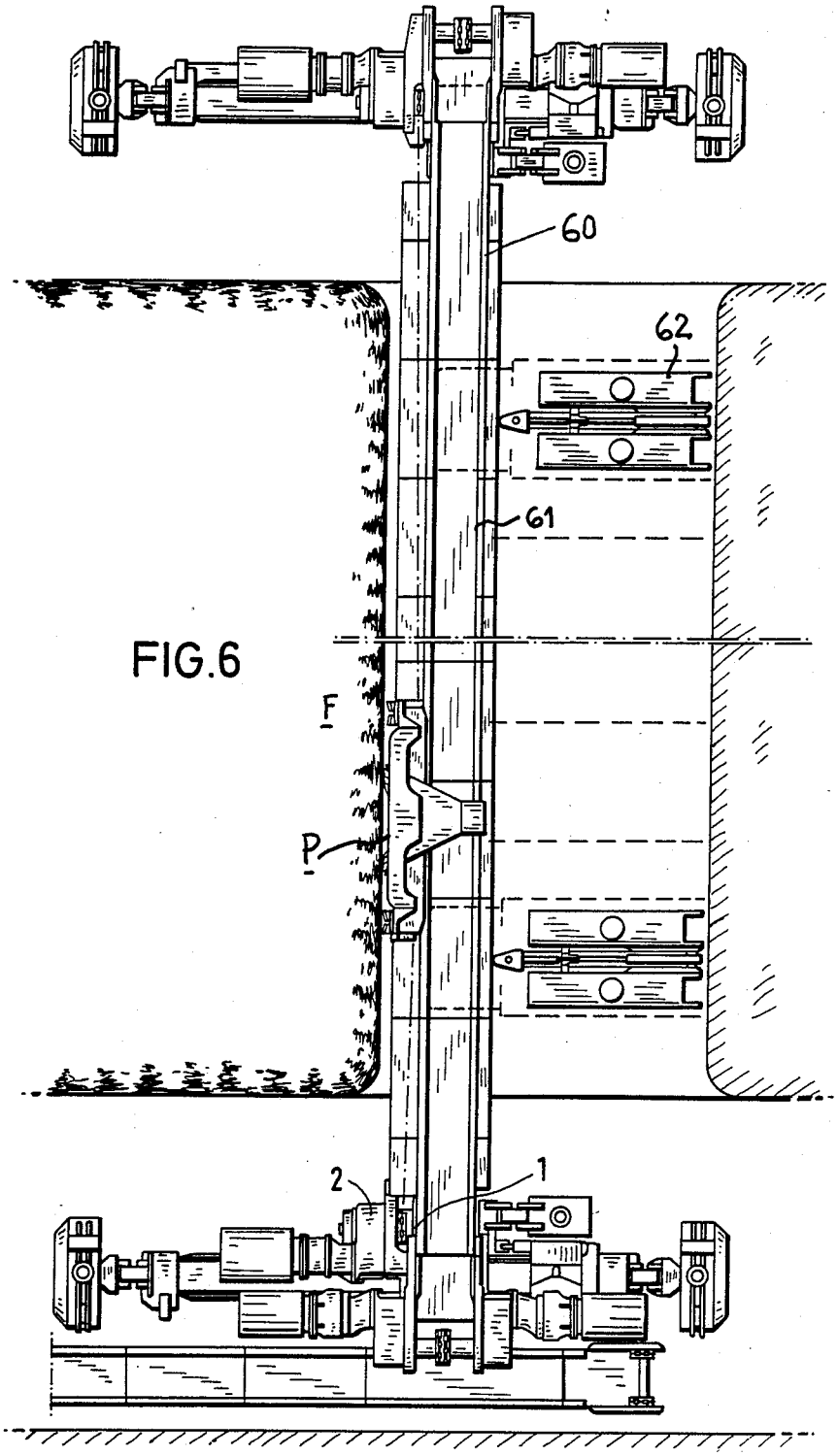
FIG. 6 is a plan view of a mineral mining installation employing a drive assembly in accordance with the invention.

As shown in FIG. 6, a mineral mining installation comprises a longwall scraper-chain conveyor 60 constructed from a series of pans 61 disposed end-to-end along an underground mine working. Roof supports 62 serve to support the roof and advance the conveyor towards the mineral face F. A plough P is propelled back and forth along the conveyor 60 to strip mineral from the face F. Main and auxiliary drive stations are provided at both ends of the conveyor. A plough drive assembly in accordance with the invention is fitted laterally onto a side plate 1 of a machine frame of the drive station. As shown in FIGS. 1 to 3, the assembly has a plough box 2 which houses a sprocket or chain wheel 4 which fits onto a drive shaft of a gearing unit 6. The box 2 which is relatively flat has a side wall nearest the gearing 6 and an aperture is provided in this wall for removing and installing the chain wheel 4. A chain stripper 8 is also provided in the box 2. As is known the stripper 8 serves to engage in a groove in the chain wheel 4 to lift the chain entrained around the wheel 4 away from the wheel 4 at the run-off side. The stripper 8 seats in a shaped pocket 11 open towards the gearing unit 6 and adjacent the periphery of the chain wheel 14.

The stripper 8 is composed of a main body 9 onto which a stripper tongue 10 is fixed laterally. The stripper body 9 fits in the pocket 11 in a shaped-locked manner and for this purpose the pocket 11 and body 9 can have a non-circular polygonal cross-section. FIG. 2 shows the pocket 11 to have a rectangular cross-section. The pocket 11 merges with the aperture 7 and is radial thereto. The stripper 8 is connected to the gearing unit 6 to form a constructional unit therewith so that by releasing and pulling-off the gearing unit 6 from the box 2 the stripper 8 moves laterally out of the pocket 11. Conversely, when the gearing unit 6 is fitted onto the plough box 2 the stripper 8 slides automatically into the pocket 11.

To fix the stripper 8 to the gearing 6 the body 9 is releasably secured to a mounting component 12, such as a flange, on the gearing unit 6. The component or flange 12 is disposed between the chain wheel 4 and the casing of the gearing unit 6 and is conveniently located on a cylindrical collar 13 on the take-off side of the gearing 6. The flange 12 is preferably rotatable on the collar 13 so that the flange 12 with the stripper 8 can pivot about the axis of rotation of the chain wheel 4. This enables the stripper 8 to be manoeuvred more easily. The flange 12 engages in the aperture 7 in the plough box as shown in FIG. 1. A radial projection 14 on the flange 12 fits into the pocket 11 and the body 9 of the stripper 8 locates on the projection 14. Bolts 15 extending parallel to the axis of rotation of the chain wheel are used to secure the stripper body 9 to the projection 14 and preferably these bolts 15 are supplemented by a keyed connection 16.

The gearing unit 6 is also engaged with the plough box 2 via abutting walls and bolts (not shown) fix the gearing unit 6 laterally to the box 2. After the bolts have been removed, the gearing unit 6 can be pulled off laterally from the plough box 2 and as this takes place the chain wheel 4 and the stripper 8 are pulled out of the box 2 through the aperture 7. This situation is depicted in FIG. 3. The chain stripper 8 with the mounting flange 12 and the plough wheel 4 can also be pulled off the gearing 6. It is however possible that after releasing the bolts 15 and pulling the chain wheel 4 off the shaft 5, the chain stripper 8 can be separated from the flange 12 which then remains on the collar 13 of the casing of the gearing unit 6. The wheel 4 and the stripper 8 can thus be replaced individually or together.

The gearing unit 6 is driven by a motor 17 fixed as by a flange-fitting to the casing of the gearing 6.

The plough box 2 is fixed at one end zone (at the left hand side of FIG. 1) to the plate 1 of the machine frame by means of long necked-down bolts 18 passing through bores 20. The box 2 can be fixed directly to the plate 1 or, as shown in FIGS. 1 and 3 with an intermediate plate 21 therebetween. The connection is preferably again effected in a shape-locked manner to cope with shear forces and as shown an annular collar 22 on the plate 21 can fit in an annular groove 23 on the side of the box nearest the frame or vice versa. The centre of the groove 23 and the collar 22 is co-incident with the axis of rotation of the wheel 4. An additional keyed connection 24 is provided between the box 2 and the plate 1 or 21 at a location spaced from the shape-locked connection 22,23. The intermediate plate 21 needs only be employed if the plate of the existing machine frame does not have the collar 22 or any components forming the keyed connection 24.

Figure 4:
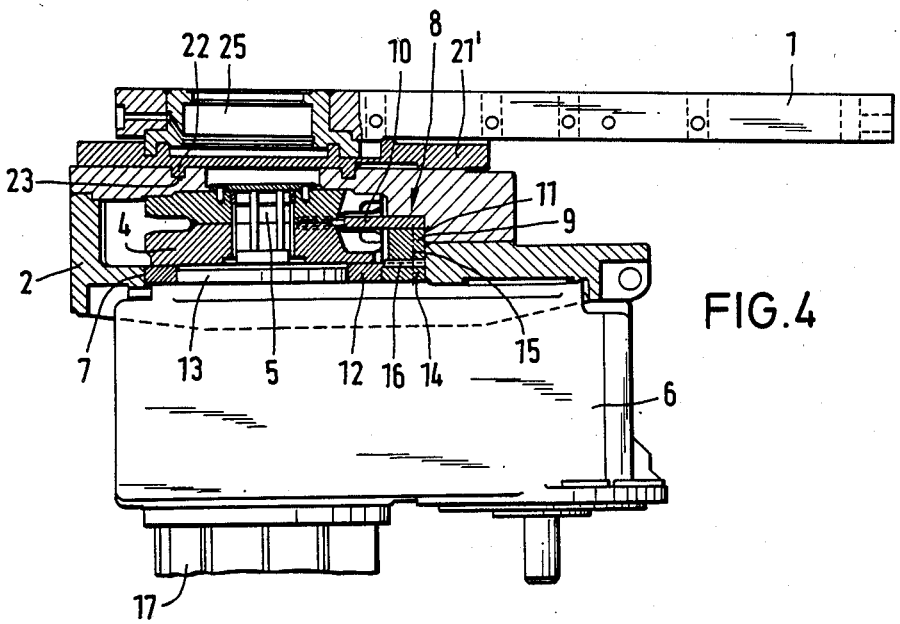
FIG. 4 is a part-sectional plan view of another plough drive assembly constructed in accordance with the invention.

The machine frame possesses further apertures 25 for locating with the drive drum of the scraper chain conveyor so that the plough drive and the conveyor drive form the so-called "F-arrangement". FIG. 4 shows an alternative assembly with the drives in the so-called "T-arrangement". In this case the plough drive with the box 2 and gearing unit 6 fits in one aperture 25 with the incorporation of a modified intermediate flange plate 211.

FIG. 5 shows a locking pawl device 26 which is located as shown in FIG. 2 on the plough box 2. This locking device 26 serves to hold the chain while the chain wheel 4 is adjusted to control the chain tension. The device 26 is a portable hand-held unit comprising a fork-shaped body or holder 28 equipped with a handle 27. A locking pawl 30 is pivotably connected with a joint 29 to one side of the holder 28. As shown in FIG. 2, the box 2 has an opening in the upper region of the end wall 19 of the box 2 for receiving the opening 51 of the holder 28. A pin or the like secures the apparatus 26 to the box 2. When fitted, the locking pawl 30 can be pivoted into engagement with the chain entrained around the wheel 4. After adjustment the device 26 can be removed ready for the next time.

We claim:

1. A drive assembly for a chain-driven mining machine, such as a plough; said assembly comprising a box mounted laterally to a side plate of a machine frame of a scraper-chain conveyor; a rotatable chain wheel located in the box, and around which a drive chain is entrained; a gearing unit with a drive shaft drivably connected to the chain wheel, the gearing unit being releasably attached to a side of the box remote from the side plate of the machine frame and a removable chain stripper located in the box, the chain stripper being composed of a body carrying a stripper tongue which projects within the chain wheel to separate the chain therefrom; wherein a pocket is provided in the box in which the stripper body is located, the pocket being open from the side of the box adjacent the gearing unit with the body and the pocket being shaped to lock the body within the pocket and the stripper body is connected to the gearing unit to form a constructional unit whereby the stripper is removed from the box when the gearing unit is detached laterally from the box.

2. An assembly according to claim 1, wherein the pocket and the stripper body have a polygonal cross-section.

3. An assembly according to claim 1, wherein the box has a side wall adjacent the gearing unit, an aperture is provided in said side wall to permit the chain wheel to be removed and installed and the pocket merges with the aperture.

4. An assembly according to claim 3, wherein the gearing unit is provided with an annular flange to which the stripper body is releasably secured and the flange fits within the aperture in the side wall of the box.

5. An assembly according to claim 1, wherein the gearing unit is provided with a mounting component and the stripper body is releasably attached to said mounting component.

6. An assembly according to claim 5, wherein the stripper body is releasably attached to the mounting component with the aid of bolts extending generally parallel to the axis of rotation of the chain wheel and a keyed connection.

7. An assembly according to claim 5, wherein the mounting component is an annular flange seated on a collar on a casing of the gearing unit.

8. An assembly according to claim 7, wherein the flange is rotatably mounted on a casing of the gearing unit.

9. An assembly according to claim 7 wherein the flange is adjustable relative to the remainder of the gearing unit.

10. An assembly according to claim 1, wherein the box is mounted to the side plate via an intermediate flange plate and an interengageable annular collar and annular groove is provided between the intermediate plate and the box with the annular collar and groove being disposed coaxial with the chain wheel.

11. An assembly according to claim 10, wherein a further keyed connection is provided between the box and the intermediate plate and the keyed connection is spaced from the annular collar and groove.

12. An assembly according to claim 1, wherein the box is provided with an opening accessible from above for receiving a portable chain locking device.

13. In or for an assembly according to claim 1 a portable hand-held chain locking device comprising a holder and a pivotal locking pawl supported by the holder for securing the drain chain during tensioning, the holder being engageable from above in an opening in the box and means for temporarily securing the holder in its operating position.

14. A locking device according to claim 13 wherein the holder has a U-shaped opening which fits onto an end wall of the box.

15. An assembly according to claim 1, wherein the box is mounted to the side plate by connection means including an interengageable annular collar and annular groove coaxial with the chain wheel.

16. An assembly according to claim 8, wherein a further keyed connection is provided between the box and the side plate and the keyed connection is spaced from the connection means.

* * * * *